US005148664A

United States Patent [19]

Suzuki

[11] Patent Number: 5,148,664

[45] Date of Patent: Sep. 22, 1992

[54] METHOD FOR STARTING OPERATION OF TWO-FOR-ONE TWISTER AFTER DOFFING

[75] Inventor: Tadashi Suzuki, Uji, Japan

[73] Assignee: Murata Kikai Kabushiki Kaisha, Kyoto, Japan

[21] Appl. No.: 709,628

[22] Filed: Jun. 3, 1991

[30] Foreign Application Priority Data

Jun. 6, 1990 [JP] Japan ..... 2-147614

[51] Int. Cl.[5] ..... D01H 1/10; D01H 7/86

[52] U.S. Cl. ..... 57/269; 57/58.83; 57/278; 57/279

[58] Field of Search ..... 57/261, 266, 268, 269, 57/270, 271, 276, 278, 279, 58.49, 58.83

[56] References Cited

U.S. PATENT DOCUMENTS

| | | | |
|---|---|---|---|
| 3,924,392 | 12/1975 | Franzen et al. | 57/261 |
| 3,939,633 | 2/1976 | Lossa | 57/261 |
| 4,127,983 | 12/1978 | Munker | 57/279 |
| 4,280,322 | 7/1981 | Inger | 57/279 X |

*Primary Examiner*—Joseph J. Hail, III

*Attorney, Agent, or Firm*—Spensley Horn Jubas & Lubitz

[57] ABSTRACT

A method for starting an operation of a two-for-one twister after doffing. It includes steps of turning a spindle for a specific period of time before or while the yarn end from a feed yarn package side is held and wound on a paper tube by a suction pipe, rotating the paper tube and the spindle for bunch winding, and drawing the yarn up to the feed roller for general take-up operation.

4 Claims, 2 Drawing Sheets

METHOD FOR STARTING OPERATION OF TWO-FOR-ONE TWISTER AFTER DOFFING

FIELD OF THE INVENTION

The present invention relates to a method for starting the operation of a processing robot in a two-for-one twister after doffing.

RELATED ART STATEMENT

Such a processing robot is known in the prior art that travels along each of a plurality of juxtaposed take-up units of a two-for-one twister and doffs take-up packages in the unit after completion of winding.

In this system, when a take-up package in some take-up unit has been fully wound, an automatic doffing device moves to the take-up unit to stop spindle rotation and to replace an empty feed yarn package. Subsequently, the leading end of the yarn is picked up and passed, and then the doffing is done. Subsequently, the end of the yarn fed out from the feed yarn package is sucked and held by a suction pipe of the processing robot, being guided to a snail wire and to a yarn guide roller, and attached on the paper tube. The paper tube, in turn, is rotated and at the same time the spindle is turned for bunch winding, then common take-up operation being started.

In a two-for-one twister equipped with a prior-art processing robot, when operation is to be restarted after doffing, the yarn end on the feed yarn package side is once held by means of a suction pipe, being drawn out without twisting and installed on a paper tube. Then the yarn is bunch-wound on the end of the paper tube; and therefore the yarn wound at least on the bunch-wound portion remains almost untwisted. Therefore, in the subsequent process, the yarn in this portion becomes unusable and has to be discarded.

OBJECT AND SUMMARY OF THE INVENTION

It is, therefore, an object of the present invention to provide a method for starting operation capable of twisting the yarn also in this portion at the time of starting the operation of the two-for-one twister after doffing by the processing robot.

In order to attain the aforesaid object, the method for starting the operation of the two-for-one twister according to the present invention after doffing includes turning a spindle for a specific period of time before or while the yarn end from the feed yarn package side is held and wound on the paper tube by means of a suction pipe of the processing robot which travels along a plurality of juxtaposed take-up units, then rotating the paper tube and the spindle for bunch winding and drawing the yarn up to the feed roller for general take-up operation.

In the aforementioned method for starting the operation, after doffing, of the two-for-one twister of the constitution described above, the spindle is turned for a specific period of time to give a desired twist to the yarn being drawn out from the feed yarn package before or while the suction pipe of the processing robot holds the leading end of the yarn unwound from the feed yarn package side and attaches it on the paper tube.

Then, the paper tube and the spindle are turned for bunch winding. Subsequently, the yarn is led to the feed roller for general take-up operation.

DETAILED DESCRIPTION OF PREFERRED EMBODIMENT

Figure 1:
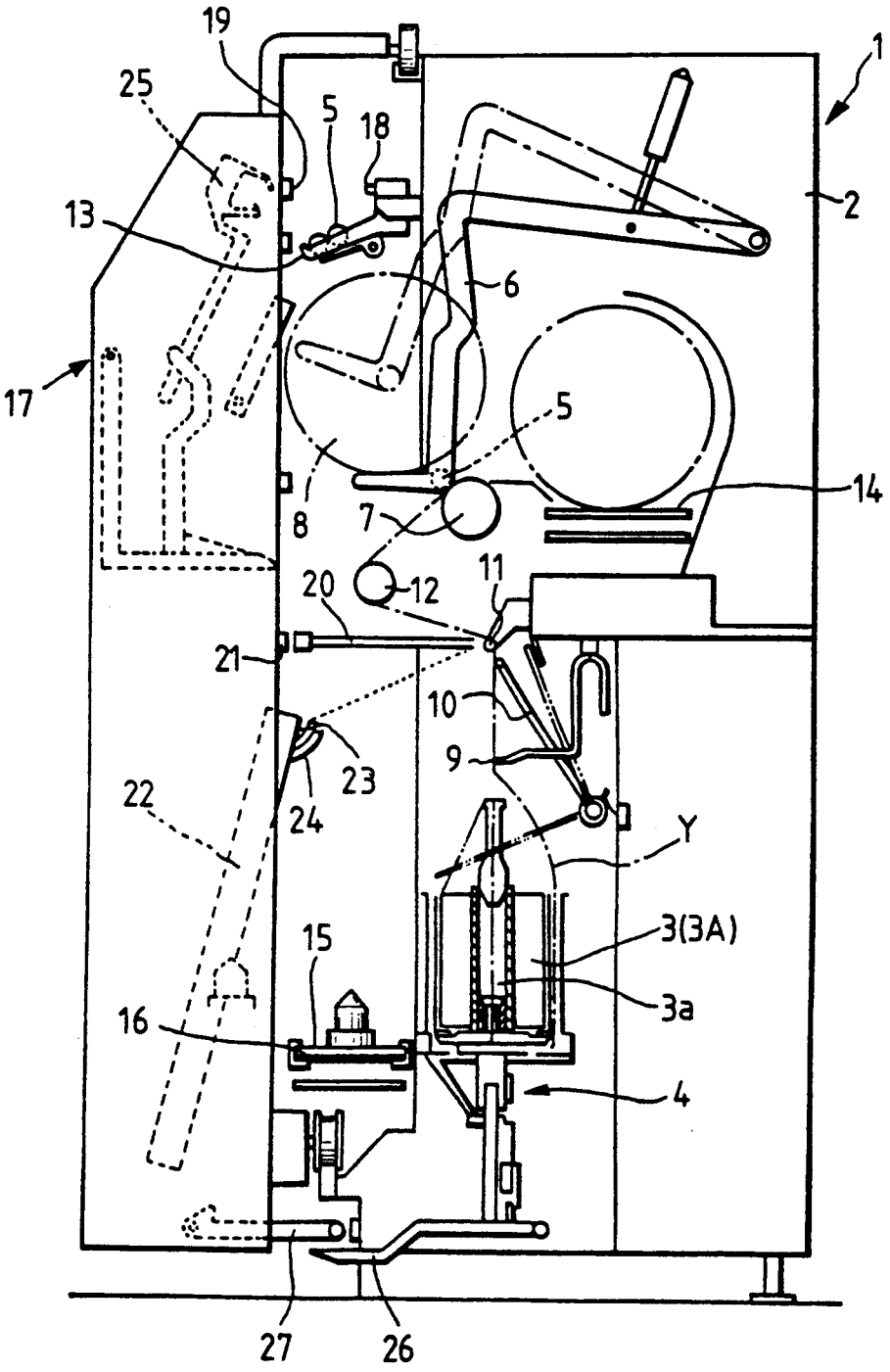
FIG. 1 is a side view of a unit of a two-for-one twister partly in section.
Figure 2:
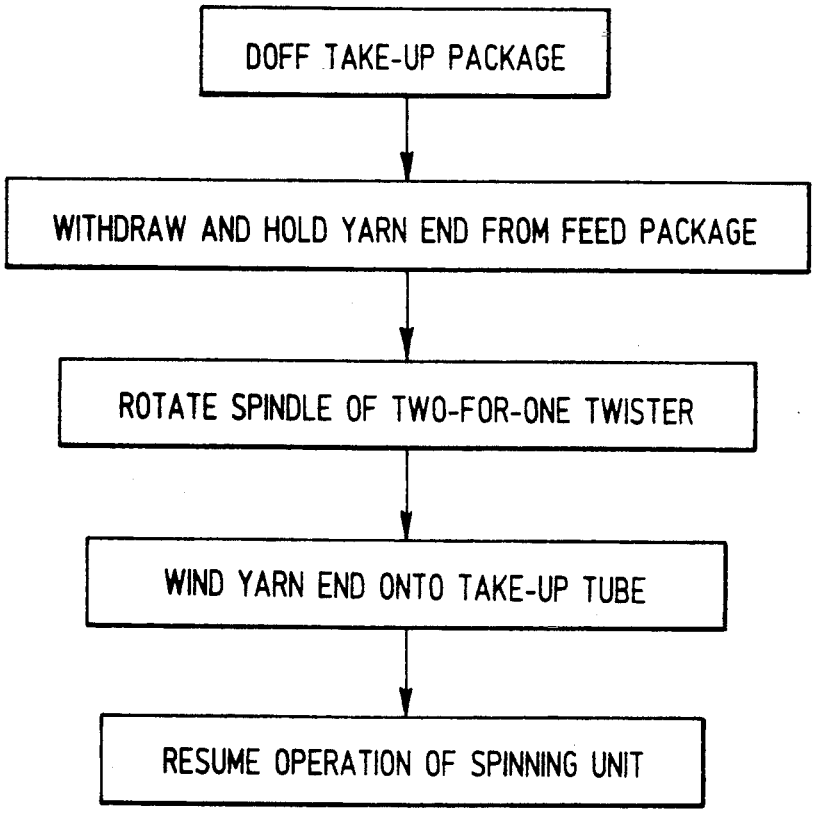
FIG. 2 shows, in the form of a block flow diagram, an example of a method in accordance with the present invention.

The two-for-one twister is equipped with a plurality of juxtaposed units, which will be explained with reference to FIG. 1 showing the side view at a certain unit of the two-for-one twister.

In the lower part of each unit 2 of a two-for-one twister 1 is located a spindle 4 which vertically supports a feed yarn package 3; and in the upper part is mounted a cradle arm 6 which horizontally supports a paper tube 5. A yarn Y drawn out from the feed yarn package 3 is passed through its axial hole 3*a*, being guided upwardly while being double-twisted, and then wound around on the paper tube 5 which is driven by a rotating drum 7, thus forming a take-up package 8.

Above the feed yarn package 3 are arranged in order a snail wire 9 for guiding the yarn, a drop wire 10 for sensing the presence and absence of the yarn Y, a yarn guide roller 11, and a feed roller 12 for supplying the yarn Y to the take-up package 8.

Above the cradle arm 6 is installed a stocker 13 for holding a plurality of paper tubes 5.

Behind the rotating drum 7 is disposed a conveyor 14 which conveys a doffed take-up package 8, and in front of the feed yarn package 3 is arranged a conveyor 16 which carries a fully-wound feed yarn package 3A on a tray 15.

Numeral 17 denotes a processing robot which travels along each unit and doffs a fully-wound take-up package in a unit. This robot is equipped with the following mechanisms.

(i) Feed yarn changeover mechanism: Replaces a fully-wound feed yarn package 3A with an empty feed yarn package supported by the spindle 4.

(ii) Yarn end drawing mechanism: Drawn out the yarn end from the feed yarn package 3A thus replaced.

(iii) Yarn inserting mechanism: Inserts the yarn end drawn out from the feed yarn package 3A into the axial hole 3*a* with a stream of air.

(iv) Doffing mechanism: Removes a fully-wound take-up package 8 supported by the cradle arm 6 and supplies an empty paper tube 5 to the cradle arm 6.

(v) Yarn attaching mechanism: Attaches the yarn end of the feed yarn package 3A to the paper tube 5 supported by the cradle arm 6.

The processing robot 17 is fitted with a sensor 19 for sensing an indicating lamp 18 and with a sensor 21 for sensing an indicating lever 20. When these sensors 19 and 21 have simultaneously sensed the lighting state of the indicating lamp 18 and the horizontal state of the indicating lever 20, the processing robot 17 is decelerated, stopping just in the front of the unit corresponding to the lever 20.

When a take-up package 8 in a unit 2 has been fully wound, the indicating lamp 18 of the unit 2 is lit and the processing robot 17 moves to the unit 2, at which the robot steps on a pedal 26 on the unit 2 side a little to stop the rotation of the spindle 4. At this time, the indicating lever 20 also is lowered, changing the feed yarn package 3A and subsequently picking the yarn end and inserting the yarn. Thereafter, doffing is performed. When the pedal lever 27 depresses the pedal 26 deep, the air is jetted out for yarn insertion.

Numeral 22 is an operating arm which is rotatably supported by the processing robot 17, and has at its forward end a suction pipe 23 for sucking and holding the leading end of the yarn inserted by the yarn inserting mechanism and a yarn guide piece 24 for guiding the yarn Y drawn out by the suction pipe 23 to the snail wire 9 and the yarn guide roller 11.

When the yarn Y is guided by the yarn guide piece 24 to the yarn guide roller 11, the operating arm 22 turns to its stowage position shown in FIG. 1, where the yarn Y is held in a state indicated by a dotted line.

In this state, the pedal lever 27 is moved upwardly to release the pedal 26 from a shallow depressed state, thus turning the spindle 4. A timer capable of setting an OFF time is inserted in a control circuit so that the pedal lever 27 will slightly depress the pedal 26 again after the lapse of a specific length of time.

As the yarn Y is twisted with the rotation of the spindle 4, the yarn drawn out from the feed yarn package 3A and held by the suction pipe 23 will be twisted. At this time, because the timer can be set to a desired time, it is possible to set the time of rotation of the spindle 4 at will to obtain a desired twisting effect. Therefore, the number of twists of the bunch wound yarn can be changed at will.

After this twisting, the yarn guide piece 24 on the forward end of the operating arm 22 moves to push obliquely upwardly the yarn Y extending between the guide roller 11 and the suction pipe 23. As a bunch guide which is not illustrated comes downwardly to catch the yarn Y and rises, a clamp cutter of a paper tube feed arm 25 provided in the upper part of the processing robot 17 operates to install the yarn end on the paper tube 5, and then the cradle arm 6 is pushed down until the paper tube 5 comes in contact with the rotating roller, thus rotating and at the same time extinguishing the indicating lamp 18. At the same time, the pedal 26 is released to turn the spindle 4, starting the take-up of the yarn Y. When the yarn Y guided by the bunch guide is wound all on the end of the paper tube 5, the bunch guide goes downwardly to transfer the yarn Y to the feed roller 12; thus general take-up operation is started and at the same time the indicating lever 20 is raised.

There has heretofore been explained an example of yarn installation to the paper tube after twisting the bunch-wound portion of the yarn. This twisting operation may be performed during yarn installation to the paper tube. The former, however, has such an advantage that yarn breakage occurs little during yarn installation to the paper tube.

According to the above-mentioned method, since the bunch-wound portion can be twisted to a desired number of twists, the bunch-wound portion of the yarn will not be discarded as a useless portion but can be used effectively in the subsequent processes.

The present invention, being of the aforementioned constitution, has the following effect.

According to this method which is applicable to all types of yarns, the bunch-wound portion of the yarn can be twisted to a desired number of twists, and therefore, will never be discarded. It can be used profitably.

What is claimed is:

1. A method for starting the operation of a two-for-one twister after doffing a take-up package in a spinning unit, comprising:

withdrawing and holding a yarn end from a feed package in the two-for-one twister, rotating a spindle of the two-for-one twister to thereby impart a twist to the held yarn end, winding the twisted yarn end onto a take-up tube to thereby form a bunch winding on the take-up tube, and resuming operation of the spinning unit, whereby the bunch winding comprises a yarn having a twist.

2. The method as in claim 1, wherein the step of withdrawing and holding a yarn end from a feed package comprises the step of introducing the yarn end into a suction pipe.

3. The method as in claim 2, comprising:

providing a plurality of spinning units, and moving the suction pipe to each of the plurality of spinning units that has doffed a take-up package.

4. The method as in claim 1, wherein the spindle is rotated for a specific duration to thereby impart a specific twist to the yarn.

* * * * *